US007691281B2

(12) United States Patent
Collier

(10) Patent No.: US 7,691,281 B2
(45) Date of Patent: Apr. 6, 2010

(54) METHOD OF PRODUCING A REFLECTIVE DESIGN

(75) Inventor: Michael Robert Collier, Denver, CO (US)

(73) Assignee: Harmony Fastening Systems, Inc., Denver, CO (US)

( * ) Notice: Subject to any disclaimer, the term of this patent is extended or adjusted under 35 U.S.C. 154(b) by 0 days.

(21) Appl. No.: 12/074,841

(22) Filed: Mar. 6, 2008

(65) Prior Publication Data

US 2008/0152796 A1 Jun. 26, 2008

Related U.S. Application Data

(63) Continuation-in-part of application No. 11/117,053, filed on Apr. 28, 2005.

(51) Int. Cl.
*B44C 1/22* (2006.01)
*B41M 3/12* (2006.01)

(52) U.S. Cl. ..... 216/94; 216/28; 216/65; 427/148; 219/121.6

(58) Field of Classification Search ..... 427/148; 216/28, 65, 94
See application file for complete search history.

(56) References Cited

U.S. PATENT DOCUMENTS

| | | | | | |
|---|---|---|---|---|---|
| 5,169,707 | A | * | 12/1992 | Faykish et al. | 428/195.1 |
| 5,344,705 | A | * | 9/1994 | Olsen | 428/32.71 |
| 5,882,463 | A | * | 3/1999 | Tompkin et al. | 156/234 |
| 6,045,964 | A | * | 4/2000 | Ellis et al. | 430/200 |
| 6,120,882 | A | * | 9/2000 | Faykish et al. | 428/195.1 |
| 6,153,128 | A | * | 11/2000 | Lightle et al. | 264/1.9 |
| 6,543,163 | B1 | * | 4/2003 | Ginsberg | 40/219 |
| 2004/0038513 | A1 | * | 2/2004 | Kohl et al. | 438/619 |

FOREIGN PATENT DOCUMENTS

JP 2000-47555 * 2/2000

* cited by examiner

*Primary Examiner*—Shamim Ahmed
(74) *Attorney, Agent, or Firm*—Dale B. Halling

(57) ABSTRACT

A method of producing a reflective design includes the steps of lasering a pattern on an adhesive side of a reflective laminated material. The lasering ablates the adhesive and causes these areas to not adhere. The reflective laminate material is applied to a substrate. A carrier layer of the reflective laminate is removed to produce a reflective design on the substrate. This method allows for highly customized designs at a reasonable cost that are very visually appealing. The substrate may be a textile, paper, or decal material. The textile may be the garment or may be a patch that is sewn onto a garment or applied to the garment with an adhesive.

15 Claims, 5 Drawing Sheets

METHOD OF PRODUCING A REFLECTIVE DESIGN

RELATED APPLICATIONS

The present invention is a continuation-in-part of the patent application Ser. No. 11/117,053, filed on Apr. 28, 2005, entitled "Method of Producing a Reflective Design on a Substrate and Apparatus".

STATEMENT REGARDING FEDERALLY SPONSORED RESEARCH

Not Applicable

THE NAMES OF THE PARTIES TO A JOINT RESEARCH AGREEMENT

Not Applicable

REFERENCE TO A SEQUENCE LISTING, A TABLE, OR A COMPUTER PROGRAM LISTING

Not Applicable

BACKGROUND OF THE INVENTION

Garments for running, cycling, footwear, hats, backpacks, jackets, pet collars, and leashes all utilize photo-reflective material for the purpose of increasing the wearer's visibility and safety after dark. This material is typically attached to the garment by sewing or is adhered using heat activated adhesive. One problem with the addition of reflective material is that it typically reduces the aesthetics of the garment in daylight. As a result, many consumers are unwilling to take advantage of the beneficial features provided by reflective materials on garments.

Thus there exists a need for more visually appealing garments that have light reflecting material.

BRIEF SUMMARY OF INVENTION

A method of producing a reflective design that overcomes these and other problems includes the steps of lasering a pattern on an adhesive side of a reflective laminate material. The reflective laminate material is applied to a substrate. A carrier layer of the reflective laminate is removed to reveal a reflective design on the substrate. This method allows for highly customized reflective designs at a reasonable cost that are very visually appealing. The substrate may be a textile, paper, or suitable decal material. The substrate may be a garment or may be a patch that is sewn onto a garment or applied to the garment with an adhesive, or a decal that can be applied to an object with a smooth surface.

DETAILED DESCRIPTION OF THE INVENTION

The present invention increases the aesthetic appeal of garments that have a reflective film. In one embodiment, the reflective film is patterned on its surface with a laser. In another embodiment, the adhesive on the backside of the reflective film is patterned with a laser, causing portions of the reflective film to not adhere to the substrate. Once laminated, the lasered film creates a reflective pattern. The pattern can be text or graphics.

Figure 1:
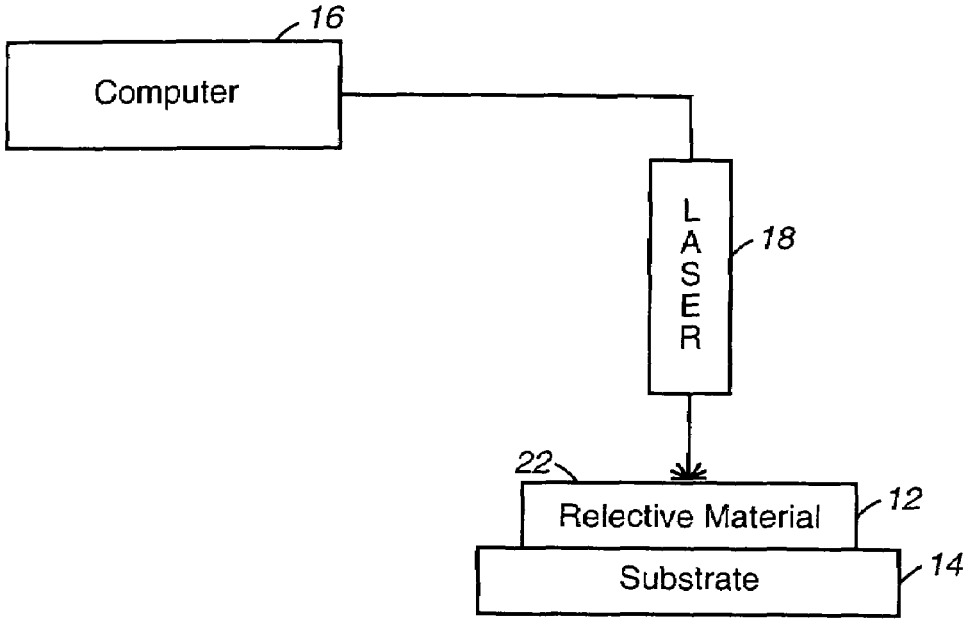
FIG. 1 is a block diagram of a system for producing a reflective design on a textile in accordance with one embodiment of the invention.

FIG. 1 is a block diagram of a system 10 for producing a reflective design on a textile in accordance with one embodiment of the invention. A reflective film 12 is laminated or sewn to a substrate 14. In one embodiment, the substrate 14 is a textile product. A pattern or design is put into a computer 16. The computer 16 directs a laser 18 and associated optics to focus the laser beam 20 onto a surface 22 of the reflective film 12. It is thought that the laser beam partially ablates and partially carbonizes the surface of the reflective material. The reflective film 12 has tiny glass beads reflectors embedded in a polymer. Where the surface is carbonized the surface looks black and the glass beads are no longer able to enhance the reflection of light. Note that the appearance of the finished product is substantially increased by only having the surface of the reflective film patterned by the laser. To achieve adequate results, the laser intensity and dwell on a particular spot need to be precisely set or the laser may not sufficiently mark the reflective film or it may burn through the reflective film. Ideally, the surface is patterned so lightly that to a user's touch the laser patterned area appears to be at essentially the same level as the rest of the front surface of the reflective film. Note that the pattern may be made by a number of dots where the laser has been focused on the surface of the reflective material. The density of the dots can be used to create shades of grey. On a colored reflective film, variations in dot density results in duotones.

In one embodiment, the laser beam is positioned at different spots on a stationary reflective film. Conversely, it is possible to move the reflective film and have the laser beam be stationary.

Figure 2:
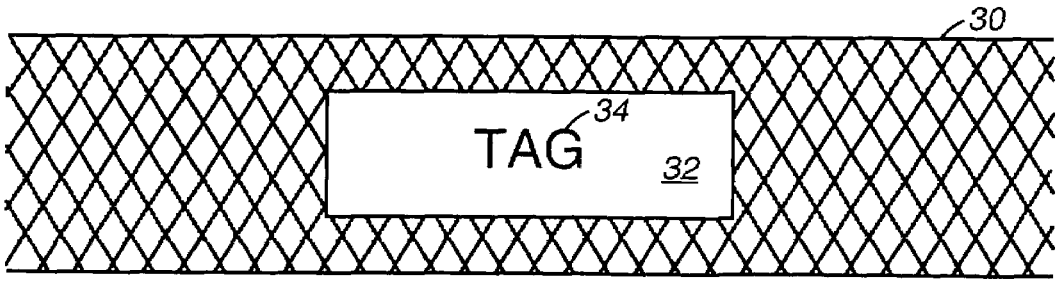
FIG. 2 is an example of a reflective design on a textile in accordance with one embodiment of the invention.

FIG. 2 is an example of a reflective design on a textile in accordance with one embodiment of the invention. A textile 30 has a reflective film 32 laminated to the textile 30. Commonly, heat activated adhesive is used to laminate the reflective film 32 to the textile 30. The reflective film 32 may be laminated by sonic welding, RF welding or any other of the well known laminating techniques. A design 34 is fashioned by a laser onto the surface of the reflective film 32. The appearance of the overall product can be enhanced by selecting a textile 30 that has smooth surface commonly associated with a higher thread count and thinner yarn. For some applications like collars, it is helpful if the webbing of the textile is braided at approximately 45 degrees to the length of the collar. When this is done, bending the collar does not result in bumps from the textile in the reflective film. Before the reflective film 32 is laminated to the textile 30 the textile may be subjected to heat and pressure. This further tightens the weave of polymer based textiles. As a result, the reflective film sits flat on the textile rather than having a bumpy looking surface. In one embodiment, the reflective film is treated with an ink before it is patterned with the laser. The ink may be an alcohol based ink.

Figure 3:
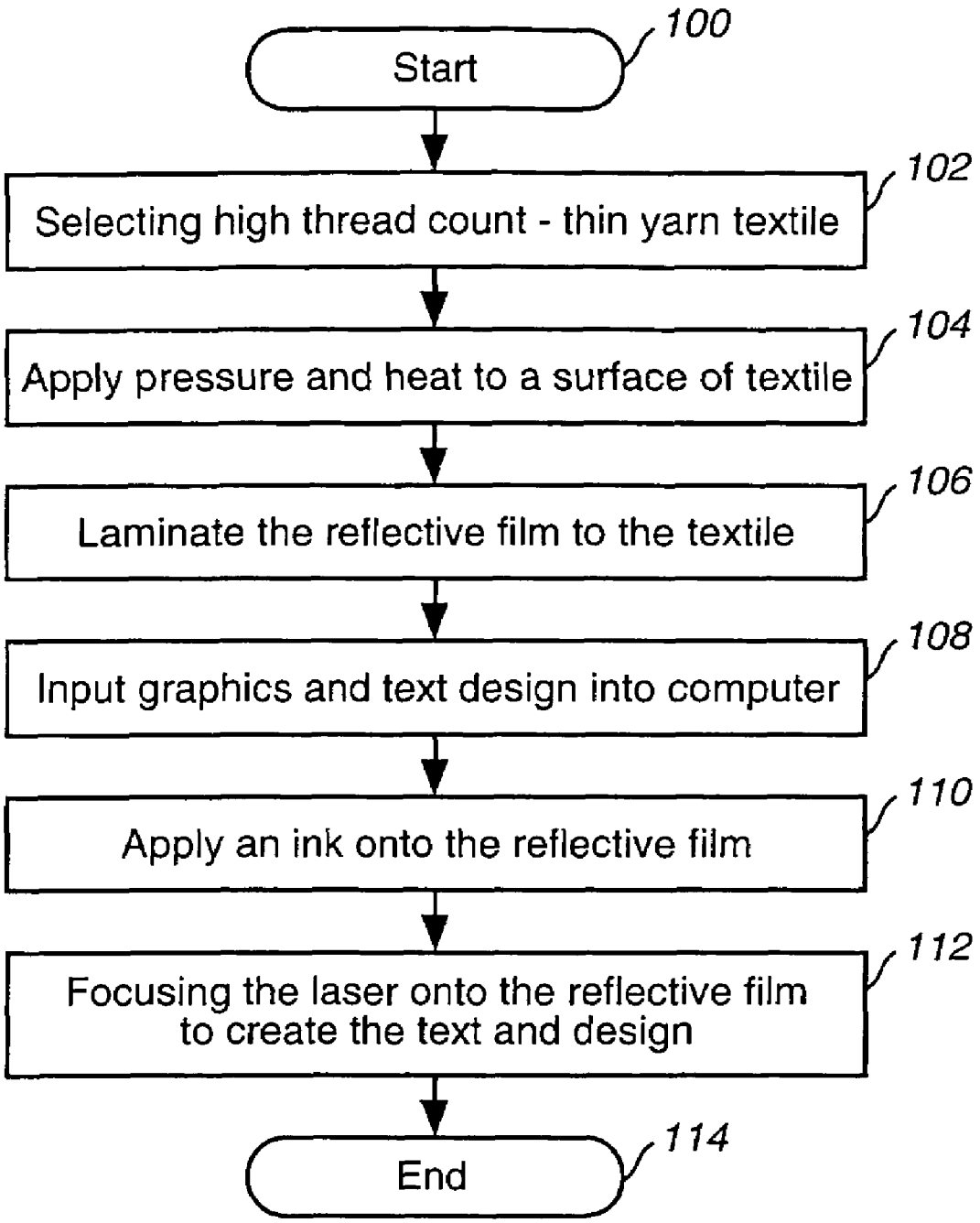
FIG. 3 is a flow chart of the steps used in producing a reflective design on a textile in accordance with one embodiment of the invention.

FIG. 3 is a flow chart of the steps used in producing a reflective design on a textile in accordance with one embodiment of the invention. The process starts, at step 100. A high thread count, thin yarn textile at step 102. In one embodiment, the textile is a polymer based textile. In another embodiment, the textile is a polymer based textile, but not nylon. Pressure and heat are applied to a surface of the textile at step 104. In one embodiment, only heat is applied to the surface of the textile. The reflective film is laminated to the textile at step 106. The graphics and text design is input into a computer at step 108. An ink may be applied to the reflective film at step 110. At step 112, the laser is focused onto the reflective film with the appropriate power and dwell settings to create the design, which ends the process at step 114.

Figure 4:
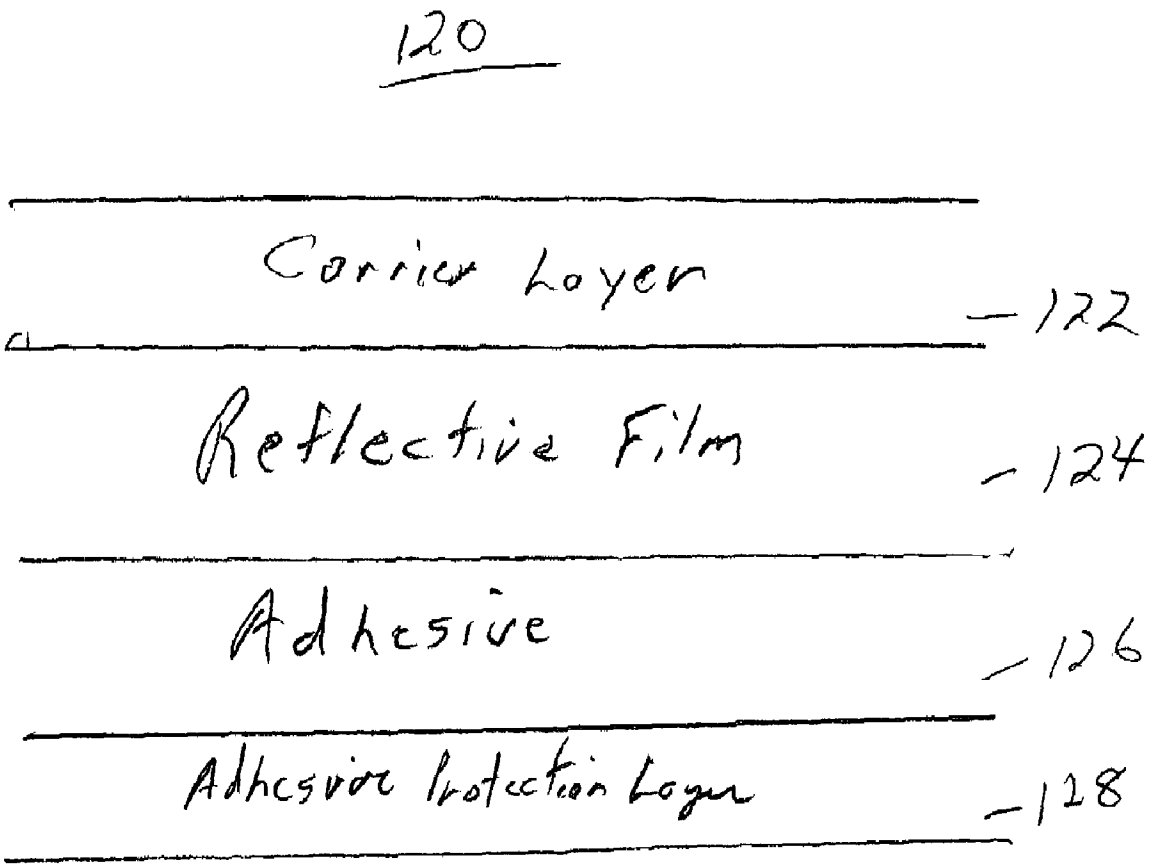
FIG. 4 is a cross sectional view of a reflective laminate in accordance with one embodiment of the invention.

FIG. 4 is a cross sectional view of a reflective laminate 120 in accordance with one embodiment of the invention. The reflective laminate 120 has a carrier layer 122, which protects the reflective film 124. An adhesive 126, commonly heat and/or pressure activated, is on an underside of the reflective film 124. An adhesive protection layer 128 protects the adhesive 126 and keeps if from accidentally becoming adhered to the wrong surface.

In order to create a pattern in the adhesive laminate 120, the adhesive protection layer 128 is removed. A laser, such as laser 18 in FIG. 1, then creates a pattern in the adhesive. By appropriately adjusting the output settings of the laser the adhesive is ablated at selected locations. Next, the reflective laminate 120 with the patterned adhesive is applied to a substrate, such as substrate 14 in FIG. 1. Application may include the use of heat or pressure or both to cause the patterned reflective laminate to adhere to the substrate. The carrier layer 122 is then removed. When the carrier layer 122 is removed areas of the reflective film 124 that had adhesive ablated by the laser are also removed. As a result, a pattern of the reflective film 124 and the substrate is formed. Note that because the pattern is created on the adhesive backside of the reflective film 124, the image has to be a mirror image of the desired end result. In one embodiment, the top side 22 (FIG. 1) of the reflective film 124 is also patterned with the laser, as discussed with respect to FIGS. 1-3. Commonly the substrate will be a textile. The textile may be a finished garment, a garment panel, or the textile may form a patch. The patch may be sewn onto a garment or may have an adhesive backing to form an iron-on patch. Alternatively, the substrate can be paper or a material used to form a decal. Note that the laser is utilized to ablate the adhesive so as used in this embodiment lasering means a process that vaporizes or neutralizes the adhesive.

Figure 5:
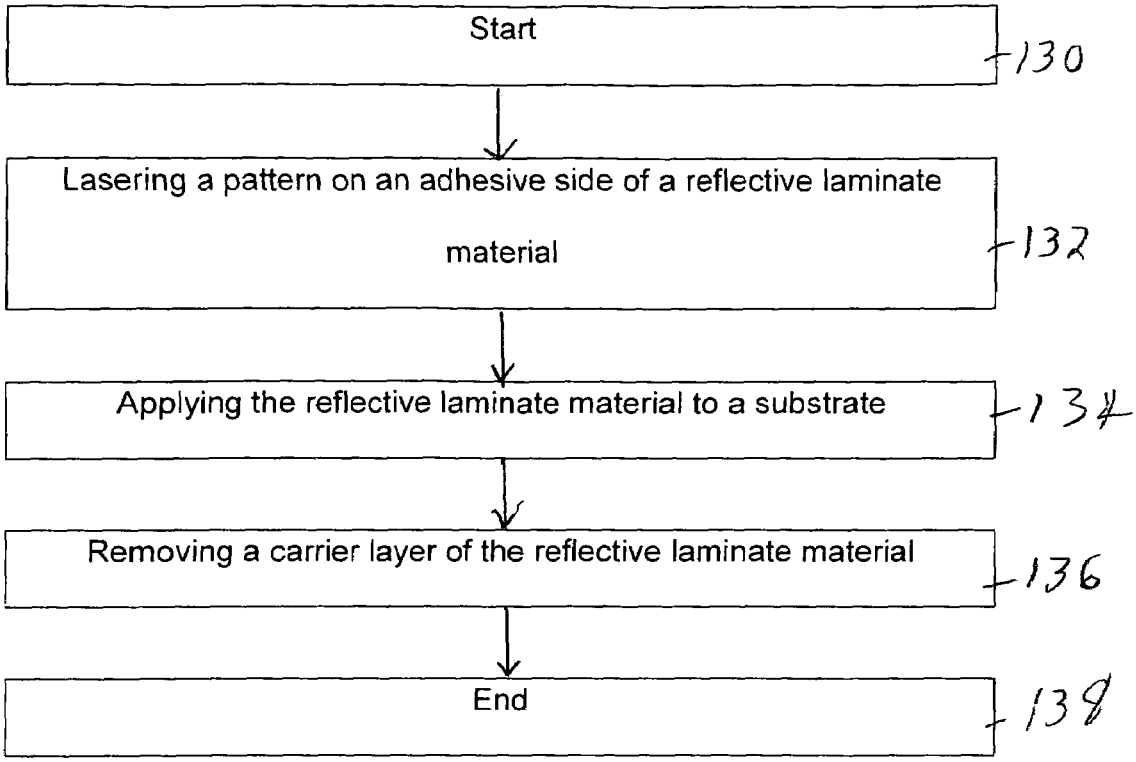
FIG. 5 is a flow chart of the steps used in producing a reflective design in accordance with one embodiment of the invention.

FIG. 5 is a flow chart of the steps used in producing a reflective design in accordance with one embodiment of the invention. The process starts, step 130, by lasering a pattern on an adhesive side of a reflective laminate material at step 132. The reflective laminate material is applied to a substrate at step 134. At step 136 the carrier layer of the reflective laminate, as well as the non-adhered laminate material is removed, which ends the process at step 138.

Figure 6:
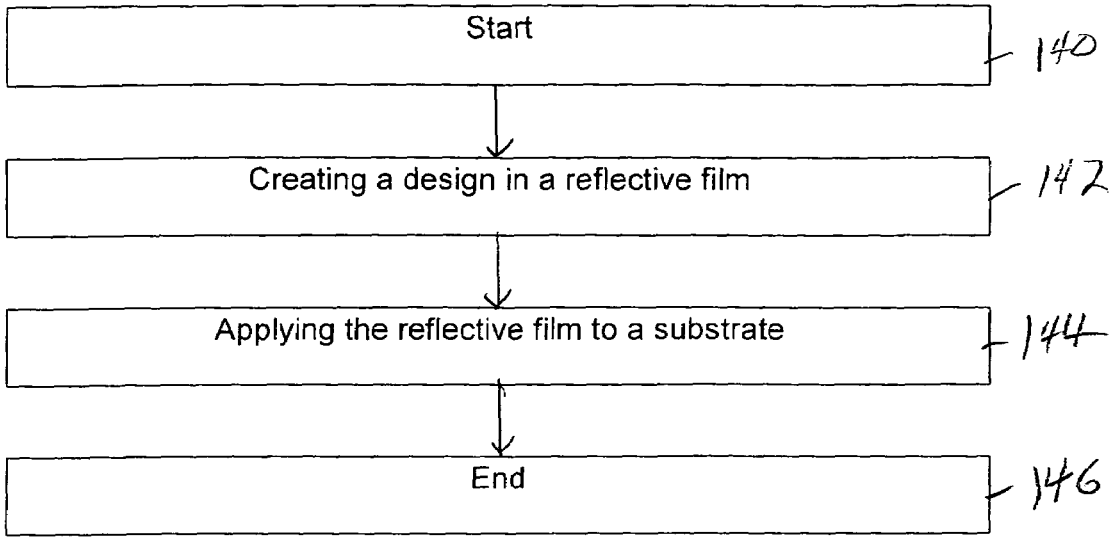
FIG. 6 is a flow chart of the steps used in producing a reflective design in accordance with one embodiment of the invention.

FIG. 6 is a flow chart of the steps used in producing a reflective design in accordance with one embodiment of the invention. The process starts step 140, by creating a design in a reflective film at step 142. At step 144 the reflective film is applied to a substrate, which ends at step 146. In one embodiment, steps 142 and 144 are reversed. Note that the substrate may be a textile, paper or a suitable decal material such as polyester film. The textile may be a garment or a patch. The patch may be sewn onto a garment or may be an iron-on patch. For an iron-on patch, the back side of the patch is a heat or pressure or combination adhesive. Commonly the laser patterned reflective film is attached to the patch textile by a heat and/or pressure adhesive. It is possible to attach the reflective film by applying heat or pressure by using a non-stick guard to protect the adhesive backside of the patch. Thus even if the adhesive on the patch is melted it is contained by the non-stick guard, such as a sheet of Teflon. Once cooled, the patch easily peels off the Teflon with the adhesive intact. The patch can later be heat applied to a garment. Alternatively, by adjusting temperature, pressure, and/or dwell time, it is possible to adhere the reflective film to the patch without activating the adhesive on the backside of the patch.

In one embodiment, the patch is made with tabs that wrap around an article and adhere to each other, thus improving adhesion of a patch to articles such as pet collars Thus there has been described a system and method for producing a reflective design on a substrate that results in more visually appealing garments that have light reflecting material.

While the invention has been described in conjunction with specific embodiments thereof, it is evident that many alterations, modifications, and variations will be apparent to those skilled in the art in light of the foregoing description. Accordingly, it is intended to embrace all such alterations, modifications, and variations in the appended claims.

What is claimed is:

1. A method of producing a reflective design, in a reflective laminate having a carrier layer, a reflective film layer, an adhesive layer and an adhesive protective layer, comprising the steps of:

a) removing the adhesive protection layer from a continuous aver of reflective laminate;

b) lasering a pattern on an adhesive layer of a reflective laminate material to remove an adhesive at selected locations, wherein the reflective film layer has plurality of glass beads;

c) applying the reflective laminate material to a substrate; and d) removing a carrier layer of the reflective laminate material, whereby portions of the reflective film layer are removed.

2. The method of claim 1, wherein the step of lasering results in ablating a portion of the adhesive.

3. The method of claim 1, wherein the step of lasering including the step of preparing a mirror image of a desired graphic.

4. The method of claim 1, furthering including the step of adjusting an output selling on a laser.

5. The method of claim 1, wherein the step of applying the reflective laminate material includes the step of applying heat to the reflective laminate material.

6. The method of claim 5, further including the step of applying pressure to the reflective laminate.

7. The method of claim 1, further including the step of d) patterning a surface of the reflective film.

8. A method of producing a reflective design in a reflective laminate having a carrier layer, a reflective film layer, an adhesive layer and an adhesive protection layer, comprising the steps of:

a) removing the adhesive protection layer from a continuous layer of the reflective laminate;

b) ablating selected portions of an adhesive to form a design in the adhesive layer; and c) applying the reflective film to a substrate, whereby portions of the reflective film layer are removed with the carrier layer is removed.

9. The method of claim 8, wherein the step of applying the reflective film to the substrate includes the step of selecting the substrate with a heat activated adhesive on one side of the substrate and laminating the reflective film to the substrate to form an iron-on patch.

10. The method of claim 8, wherein the step of applying the reflective film to the substrate includes the step of selecting a paper as the substrate.

11. The method of claim 9, wherein the step of applying the reflective film to the substrate includes the step of selecting a decal material as the substrate.

12. The method of claim 11, further including the step of applying an adhesive to the substrate.

13. The method of claim 8, wherein the step of creating the design in the reflective film includes the step of lasering a pattern on an adhesive side of a reflective laminate material.

14. The method of claim 8, wherein the step of creating the design in the reflective film includes the step of lasering a pattern on a top surface of the reflective film.

15. The method of claim 8, further including the step of wrapping a pair of tabs of the substrate around an article and adhering the pair of tabs to each other.

* * * * *